United States Patent [19]

Hicks et al.

[11] Patent Number: 5,013,219

[45] Date of Patent: May 7, 1991

[54] POSITIVE DISPLACEMENT PISTON PUMP

[75] Inventors: Douglas C. Hicks, Lewes, Del.; Charles M. Pleass, Havre De Grace, Md.

[73] Assignee: The University of Delaware, Newark, Del.

[21] Appl. No.: 371,315

[22] Filed: Jun. 26, 1989

Related U.S. Application Data

[60] Continuation-in-part of Ser. No. 309,041, Feb. 9, 1989, abandoned, which is a division of Ser. No. 32,351, Mar. 31, 1987, abandoned.

[51] Int. Cl.[5] ..... F04B 1/14

[52] U.S. Cl. ..... 417/269; 417/DIG. 1

[58] Field of Search ..... 417/269, 271, DIG. 1; 92/71, 170; 74/DIG. 10; 184/6.17; 91/499, 506

[56] References Cited

U.S. PATENT DOCUMENTS

| | | | |
|---|---|---|---|
| 2,709,339 | 5/1955 | Edelman et al. | 74/DIG. 10 X |
| 2,913,993 | 11/1959 | Joulmin, Jr. | 91/499 X |
| 2,962,974 | 12/1960 | Porkert | 74/DIG. 10 X |
| 3,016,837 | 1/1962 | Dlugos | 417/269 |
| 3,018,737 | 1/1962 | Cook et al. | 417/269 X |
| 3,053,186 | 9/1962 | Gondek | 417/252 |
| 3,110,530 | 11/1963 | Herman | 74/DIG. 10 X |
| 3,221,564 | 12/1965 | Raymond | 417/269 X |
| 3,407,746 | 10/1968 | Johnson | 417/DIG. 1 X |
| 3,418,942 | 12/1968 | Partos | 417/269 X |
| 3,703,125 | 11/1972 | Pauliukonis | 92/170 X |
| 3,754,842 | 8/1973 | Schlanzky | 417/269 |
| 3,811,798 | 5/1974 | Bickford | 417/269 |
| 3,818,803 | 6/1974 | Scott et al. | 91/499 |
| 3,839,946 | 10/1974 | Paget | 92/170 X |
| 4,105,369 | 8/1978 | McClocklin | 417/269 |
| 4,503,754 | 3/1985 | Irwin | 91/493 |
| 4,617,856 | 10/1986 | Miller et al. | 74/60 |
| 4,688,999 | 8/1987 | Ames et al. | 417/DIG. 1 X |

FOREIGN PATENT DOCUMENTS

| | | | |
|---|---|---|---|
| 511189 | 1/1955 | Italy | 417/269 |
| 569146 | 11/1957 | Italy | 417/269 |

OTHER PUBLICATIONS

Cole-Parmer Catalog, 1985-1986, pp. 554-556.

*Primary Examiner*—Leonard E. Smith
*Attorney, Agent, or Firm*—Connolly & Hutz

[57] ABSTRACT

A high pressure, positive displacement piston pump for pumping a corrosive fluid is disclosed. The pump includes a pump body having a plurality of cylinders therein, each provided with an inlet and an outlet. A suitable one-way valve device is disposed in a connection between the inlet and the cylinder, and another oppositely directed one way-valve device is disposed in a connection betweenn the outlet and each cylinder. A piston is disposed in each cylinder for reciprocal movement therein in order to pump the fluuid from the inlet to the outlet. A cam device moves each piston reciprocally and includes a rotating member having a first camming surface which is cylically rotated adjacent an end of each piston. At the end of each piston, a second camming surface is provided which engages the first camming surface. A cooling system is also provided for cooling and lubricating the first and second camming surfaces with a coolant liquid in contact with the bearing surfaces within the pump. The coolant liquid can be and in the preferred embodiment is the corrosive liquid being pumped. A shaft is preferably used for rotating the rotating member and a suitable journaling device is provided for the shaft. The shaft is also non-corrodible, and the coolant liquid also cools and lubricates the journaling device as well as the shaft.

20 Claims, 2 Drawing Sheets

POSITIVE DISPLACEMENT PISTON PUMP

CROSS-REFERENCE TO RELATED APPLICATIONS

This application is a continuation-in-part application Ser. No. 309,041, filed Feb. 9, 1989, now abondoned, which in turn is a division of Ser. No. 32,351, filed Mar. 31, 1987 and now abandoned.

FIELD OF THE IVNENTION

The present invention relates generally to pumps, and more particularly to a high pressure, positive displacement piston pump for pumping a corrosive fluid.

. Background of Invention

In general, commercially available high pressure pumps used in reverse osmosis seawater desalination systems rely on a combination of expensive metal alloys in the fluid pumping end to withstand the corrosive effects of seawater. For positive displacement type pumps, a transmission is required to convert the rotary drive input into the linear pumping motion. Conventional systems rely on an oil bath to cool and lubricate the drive-end of the transmission, and dynamic seals to isolate the oil from the seawater in the fluid-end. These designs require frequent replacement of the oil/water seals and periodic (approximately every 300–500 hours) transmission oil changes. In addition, the combination of metal alloys commonly used in the fluid-end frequently results in electrolysis and premature failure of components such as valve springs, seats, and seals.

A radial piston pump having radially movable pistons is disclosed in U.S. Pat. No. 4,222,714. The ends of the pistons which contact an eccentric shaft provided with a cam track are covered with a layer of polytetrafluoroethylene. Similarly, U.S. Pat. No. 3,221,564 describes a plastic piston shoe for use in axial piston pumps. A high pressure pump utilizing plastic bearings for use in applications only as car washes is described in U.S. Pat. No. 3,407,746. There is no suggestion in the prior art of a high reliability, high pressure piston pump prepared from plastic and composite materials capable of continuous operation.

SUMMARY OF THE INVENTION

In accordance with the present invention, a high pressure, positive displacement piston pump for pumping a corrosive fluid is provided. The pump includes a pump body having a plurality of cylinders therein, each provided with an inlet and outlet through the pump body to the cylinder. An inlet one-way valve means and an outlet one-way valve means are disposed, respectively in the inlets and outlets for allowing pumped fluid flow into and out of each cylinder. A piston is disposed in each cylinder for reciprocal movement therein in order to pump the fluid from the inlet to the outlet. A cam means is provided for moving the piston reciprocally in each cylinder. The cam means includes a rotating member having a first camming surface which is cyclically rotated adjacent an end of each piston. A second camming surface at the end of each piston engages the first camming surface to move the piston reciprocally. The first camming surface is preferably formed from a corrosion resistant metal alloy such as stainless steel, monel, titanium, etc. Other suitable materials include ceramics, Imilon, polysulfone, and high polymerized organic materials. The second camming surface is preferably formed of an organic material preferably selected from the polymer group consisting of epoxies, polyvinyl chloride, acetal, polyester, polyimide, polyamide, polyamide-imide, teflon, ultra high molecular weight polyethylene, and polyurethane. These materials are considered to include those materials also having internal lubricates, such as PTFE, molydisulfide, etc., and reinforcing from fibers as desired. In low duty cycle applications, both the first and second camming surfaces may be formed from two different organic materials selected from those listed above. A cooling means is further provided for cooling and lubricating the first and second camming surfaces. The cooling means includes a liquid coolant which contacts the first and second camming surfaces.

In one preferred embodiment of the present invention, the coolant is liquid water or a so of salts in liquid water. This water is conducted onto the first and second camming surfaces in order to cool and lubricate these surfaces. In addition, this water serves to cool and lubricate the reciprocating pistons as well as other bearing surfaces within the pump. Where the pump of the present invention is used for pumping water, seawater, or other aqueous solutions, the pumped fluid itself can be used as the coolant water. In such a situation, the coolant water can be conducted from the pressurized inlet of the pump to the camming and bearing surfaces to be cooled and lubricated. In other situations where the liquid being pumped is suitable as a coolant liquid, a portion of the pressurized pump liquid from the inlet or outlet can similarly be used for cooling and lubrication. Alternatively, a separate fluid stream, of for instance fresh water could be used.

In one preferred embodiment, the rotating cam member includes a shaft and a means for journaling the shaft for rotation in the pump body. In this embodiment, the shaft is made from a non-corrodible metal alloy. The shaft could be journaled by bearings made of a material from the above-mentioned polymer group. In addition, the cooling and lubrication means also acts to cool the journaling means of the shaft. Preferably, the rotating member is a swash plate on which the first camming surface is provided. With such a construction, the cam means also preferably further includes wear pads located on the pump body on the opposite side of the swash plate from the first camming surface so that the swash plate bears against the wear pads as the first and second camming surface are engaged to move the piston during pumping. The wear pads are also preferably made of a material from the above-mentioned polymer group.

In one preferred embodiment, there are a plurality of cylinders and associated pistons. In addition, the first camming surface is preferably made of a corrosion resistant metal alloy. The means for journaling the shaft, the second camming surface and the wear pad are then made of polyamide-imide or polyimide plastic. In lower pressure applications (below 500 psi), the second camming surface and wear pads are made of ultra high molecular weight polyethylene and the first camming surface is preferably made of an epoxy.

It is an advantage of the present intention that a corrosive fluid, such as seawater, is pumped by a pump constructed of easily and cheaply cast or injection molded parts.

It is also an advantage of the present invention that whereas a portion of the pump fluid is used to cool and lubricate the pump, the seals between the pump fluid and cooling fluid are not required to completely isolate the two fluids so that the mixing of the two fluids by leakage is no longer a primary design concern as some leakage is easily tolerated.

It is a further advantage of the present invention that the pump so constructed is long lasting, and requires little servicing. Thus, the pump of the present invention will function continuously for long periods of time without need for any maintenance while conveying corrosive fluids in what might be a hostile or inaccessible environment.

Other features and advantages of the present invention are stated in or apparent from a detailed description of a presently preferred embodiment of the invention found hereinbelow.

DETAILED DESCRIPTION OF THE PREFERRED EMBODIMENTS

Figure 1:
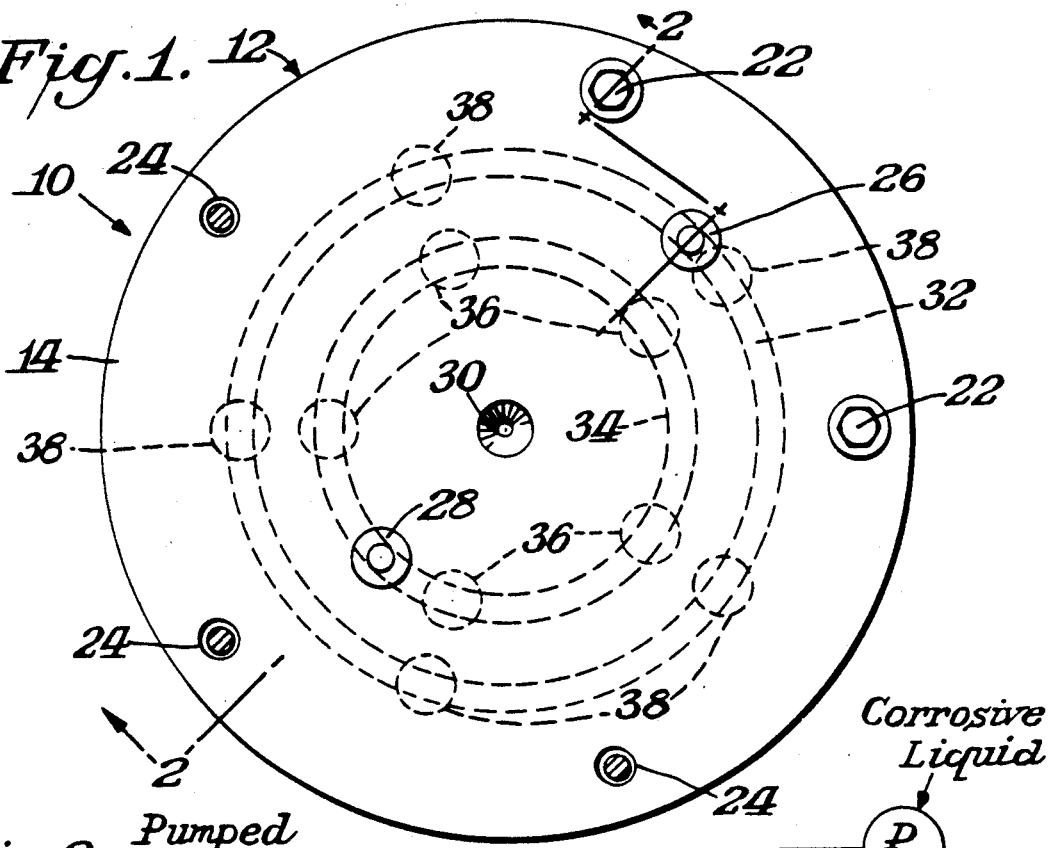
FIG. 1 is a top plan view of a pump according to the present invention.
Figure 2:
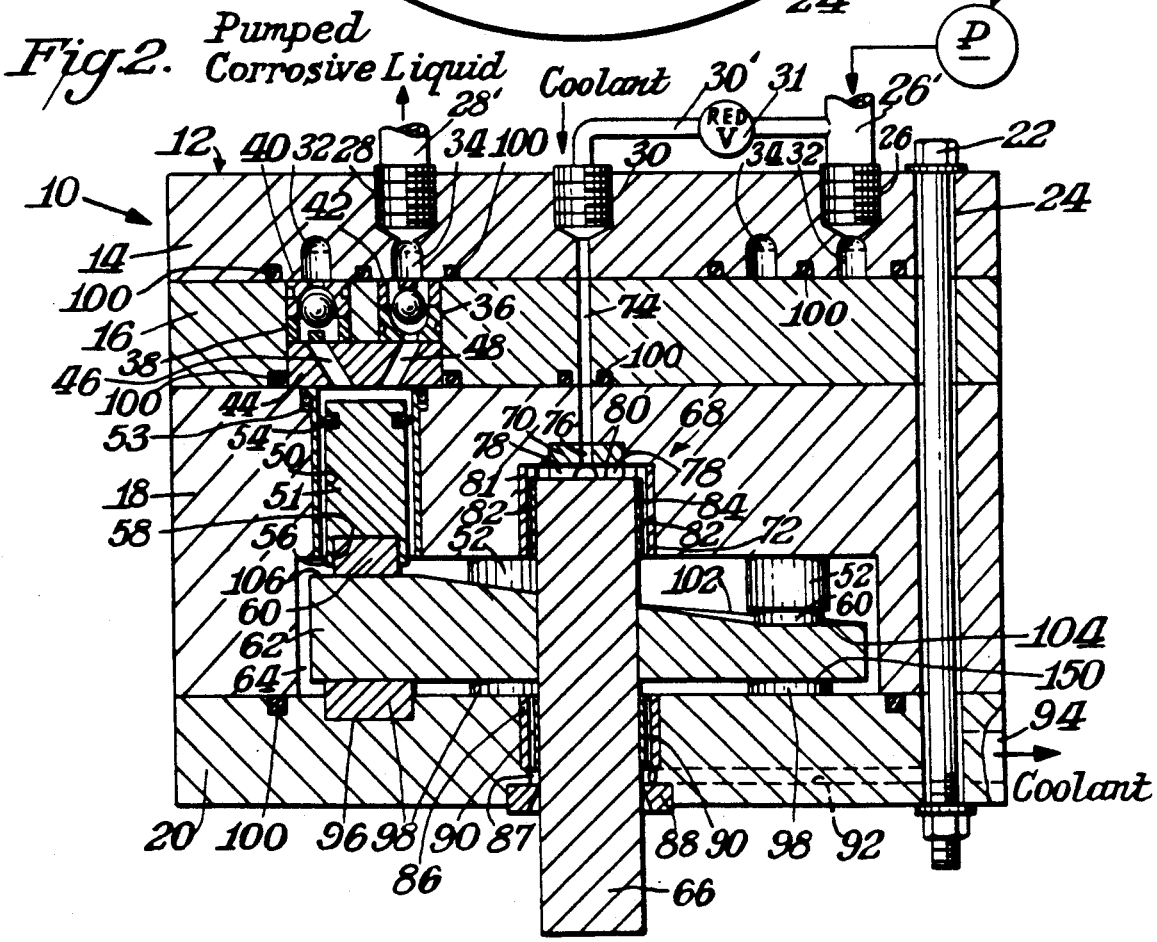
FIG. 2 is a cross-sectional elevation view of the pump depicted in FIG. 1 along the line 2—2, and also showing the inlet and outlet for the pump.
Figure 6:
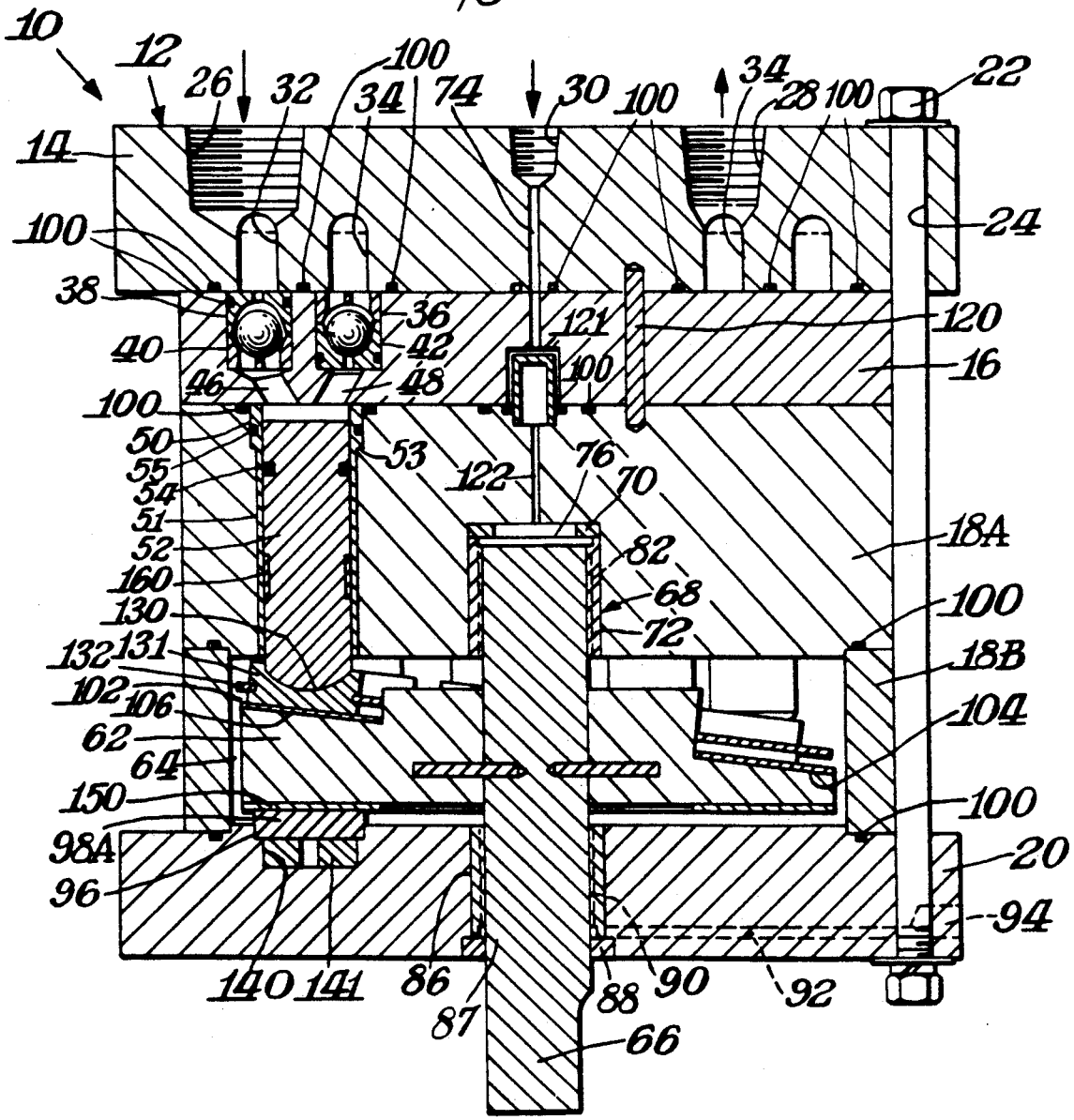
FIG. 6 is a view similar to FIG. 2 of a further embodiment of this invention particularly suited for both high and low pressure and high and low speed applications.

With reference now to the drawings in which like numerals represent like elements throughout the several views, presently preferred embodiments of a high pressure, positive displacement piston pump 10 is depicted in FIGS. 1, 2 and 6. Pump 10 includes a pump body 12 which is comprised of a gallery 14, a valve housing 16, a cylinder housing 18, and a bearing plate 20. Pump body 12 is held together by a plurality of bolt means 22 such as depicted in FIGS. 1, 2 and 6 which extend through bores 24 in pump body 12. Conveniently, bolt means 22 are also non-corrodible and are made of stainless steel, brass, or the like.

The pump body shown in FIG. 2 can also be formed from separate parts as shown in FIG. 6 by elements 18A and 18B. For reduction in weight and cost the diameter of elements 16, 18, 18A and 18B can be reduced to lie inside the stay bolts with pins 120 used to align the pump body parts.

Gallery 14 includes an inlet port 26, an outlet port 28, and a coolant inlet port 30. Ports 26, 28 and 30 are configured to receive pipings 26', 28' and 30' Inlet coolant piping 30' is fluidly connected to inlet piping 26' through a reduction valve 31. As shown in FIG. 2 or through a strainer 121 and orifice 122 as shown in FIG. 6 to reduce the feed pressure. Inlet port 26 is fluidly connected to a circular inlet channel 32 extending circumferentially in gallery 14 concentric to coolant inlet port 30. Outlet port 28 is similarly connected to a circular outlet channel 34 inside and concentric with inlet channel 32. It should be appreciated that inlet port 26 and outlet port 28 have been depicted in FIGS. 2 and 6 for clarity. These ports are not properly part of the depicted cross section of pump 10, but rather would be at a position not viewable in the depicted cross section of line 2—2 in FIG. 1. However, the exact radial and angular position of these parts is not critical to the operation of the present invention.

In the preferred embodiments of pump 10, valve housing 16 includes five bores 36 located equidistant from one another and underneath of a prospective portion of outlet channel 34. Immediately adjacent each bore 36 is a bore 38 located underneath a respective portion of inlet channel 32. Disposed in each bore 38 is an inlet one-way valve means 40. Located in each bore 36 is an outlet one-way valve means 42. A respective retainer 44 is located below each respective pair of bores 36 and 38 in FIG. 2 to hold valve means 40 and 42 in valve housing 16. Retainer 44 includes an inlet bore 46 and an outlet bore 48 which lead from and to, respectively, inlet one-way valve means 40 and outlet one-way valve means 42. This retainer 44 can be incorporated into the construction of valve housing 16 shown in FIG. 6. One-way valve means 40 and 42 are similar in appearance to conventional ball valves typically having three apertures at the sealing end and four apertures at the opposite end.

Cylinder housing 18 includes a cylinder 50 provided with a liner 51 located immediately below each respective retainer 44. Liner 51 is held in place by abutment of a shoulder 53 with cylinder housing 18 and with retainer 44 or valve housing 16. An O-ring seal 55 is located in shoulder 53 as shown. Disposed in each cylinder 50 and associated liner 51 is a piston 52 having a suitable sealing means 54 with a respective cylinder liner 51. In FIG. 2, at an end 56 opposite retainer 44, each piston 52 includes a cylindrical bore 58. Press fit in each bore 58 and extending away from the respective piston 52 is a camming surface in the form of a piston wear pad 60. Each piston wear pad 60 is designed to engage a swash plate 62 mounted for rotation within a cavity 64 provided in cylinder housing 18. Swash plate 62 is mounted for rotation about a shaft 66 which is rotated by a suitable motor or the like.

In FIG. 6 the second camming surface at the end of piston 52 is formed by hemispherical ball and socket joint 130 and slipper bearing 131. The slipper bearings can be held in proper alignment beneath each piston 52 by means of a loose fitting ring such as 132, however other provisions such as pins could also be employed. To reduce wear and friction on piston 52, a wear sleeve 160 can be used as shown in FIG. 6.

Figure 5:
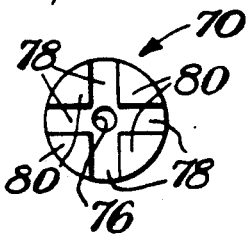
FIG. 5 is a bottom plan view of the thrust bearing of the embodiment of FIG. 2.

In cylinder housing 18, shaft 66 is journaled for rotation by a suitable journaling means 68 which includes a thrust bearing 70 and a shaft bearing 72. As shown in FIG. 2, coolant inlet port 30 is connected by a bore 74 to an aperture 76 in the top of thrust bearing 70. As shown best in FIG. 5, aperture 76 of thrust bearing 70 opens into a plurality of radially directed channels 78 for conduction of the cooling liquid. Thus, located between channels 78 are the thrust surfaces 80 which may engage the end of shaft 66.

Figure 2A:
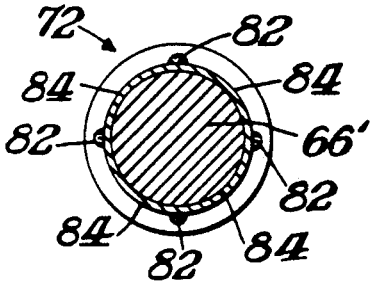
FIG. 2A is a top plan view of the shaft bearing of the present invention.
Figure 3:
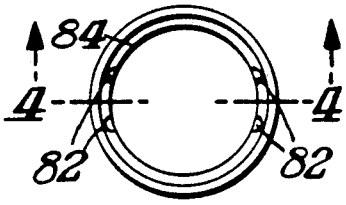
FIG. 3 is a top plan view of the shaft bearing of the embodiment of the invention shown in FIG. 6.
Figure 4:
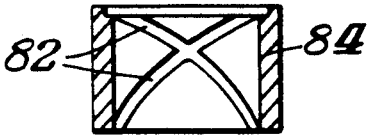
FIG. 4 is a cross-sectional view taken through FIG. 3 along the line 4—4.

Shaft bearing 72 is depicted in greater detail in FIGS. 2A and 3. As shown, shaft bearing 72 includes channels 82 along the interior surface thereof between which bearing surfaces 84 for shaft 66 are located. With reference again to FIG. 2, it should be appreciated that channels 78 of thrust bearing 70 need not be aligned with respective channels 82 of shaft bearing 72 because channels 78 terminate in an annular space 81, and annular space 81 is fluidly connected to the top portions of channels 82 as shown. Thus, coolant liquid is readily conducted from coolant inlet port 30 via bore 74, channels 78, and channels 82, into cavity 64 in order to cool shaft 66.

Shaft 66 is also journaled for rotation by a second shaft bearing 86 located in bearing plate 20 above an annular space 87. Providing a seal around shaft 66 below annular space 87 is a sealing ring 88. Shaft bearing 86 includes channels 90 similar to channels 82 in shaft bearing 72 which conduct the coolant liquid into annular space 87. Annular space 87 opens laterally into bore 92 in bearing plate 20 which leads to a coolant outlet port 94 as shown.

In FIG. 2, bearing plate 20 also includes a plurality of cylindrical bores 96, with each bore 96 located opposite a respective cylinder 50 in cylinder housing 18. Press fit in each cylindrical bore 96 is wear pad 98.

In FIG. 6 bearing plate 20 includes a plurality of cylindrical bores 96 and counterbores 140 offset to bores 96. Fit in each cylindrical counterbore 140 is an elastic supporting pad 141 used to support wear pad 98A in each bore 96 and allow the wear pad to easily incline to an efficient position to hydrodynamically lubricate swash plate 62.

In order to provide for sealing along the mating faces of gallery 14, valve housing 16, cylinder housing 18 (or 18A and 18B), and bearing plate 20, sealing means 100 are provided. Typically, each sealing means 100 is a suitable O-ring provided in a circular channel in one of the mating faces.

Swash plate 62 includes a camming surface in the form of a circumferential ramp surface 102 which extends from a lower-most surface portion 104 to uppermost surface portion 106. Thus, as swash plate 62 is rotated, each piston 52 is raised by contact with ramp surface 102 to provide a pumping action for the corrosive liquid. (The water pressure during refill lowers the pistons.) Similarly, swash plate 62 includes a bearing surface 150 to run against wear pads 98. Surfaces 102 and 150 can either be an integral part of swash plate 62 or can be separate disks bonded in place, or can be surface coatings.

Pump 10 is specifically designed for the pumping of a corrosive liquid, such as seawater or other aqueous corrosive liquids (including fresh water). For this reason, the elements of pump 10 are specifically constructed to be non-corrodible while still operating effectively without significant wear. It should also be appreciated that these materials are usable in a pump according to the present invention due to the cooling and lubrication of the coolant liquid conducted through pump 10. In general, with the exception of the sealing means (which are generally elastomers) and shaft 66 which is currently stainless steel due to the high forces generated (it should be noted that shaft 66 could also be of a material covered by a plastic selected from the below identified polymer group such as shown by shaft 66' in FIG. 2A, or possibly of a suitable plastic or composite material with fiber reinforcing for the whole shaft), the remaining elements of pump 10 are made of organic materials which are preferably selected from the polymer group consisting of epoxies, polyvinyl chloride, acetal, polyester, polyimide, polyamide-imide, teflon, ultra high molecular weight polyethylene, and polyurethane (including such materials also having fillers to increase strength or reduce friction).

In particular, the preferred material for gallery 14, valve housing 16, cylinder housing 18, bearing plate 20, and swash plate 62 is a glass reinforced epoxy resin. Surfaces 102 and 150 on the swash plate 62 are preferably made of epoxy resin for low pressure applications or stainless steel or noncorrodible metal alloys, ceramics, glasses or highly polymerized organics. Polyacetal is advantageously used for constructing inlet one-way valve means 40 and outlet one-way valve means 42, while glass filled DELRIN is the preferred material for constructing retainer 44. Teflon filled acetal is the preferred material for pistons 52 while liners 51 are preferably made with a neat epoxy for low pressure applications or stainless steel for high pressures. An ultra high molecular weight polyethylene is preferred for piston wear pads 60 and wear pads 98. Finally, graphite and teflon filled polyamide-imide or polyimide are the preferred materials for thrust bearing 70, shaft bearing 72, shaft bearing 86, slipper bearing 131, piston wear ring 160 and wear pad 98A.

In operation, pump 10 functions in the following manner. Initially, shaft 66 is connected to a suitable motor or the like in order to drive shaft 66 in rotation about its longitudinal axis. In addition, a suitable connection using inlet piping 26' is made between inlet port 26 and the corrosive liquid to be pumped, which is under low pressure in this preferred embodiment. Similarly, a suitable connection using outlet piping 28' is also made between outlet port 28 and the area to which the corrosive liquid at high pressure is to be pumped. Finally, coolant inlet port 30 is connected via piping 30' to a suitable source of coolant, such as the liquid under low pressure in inlet piping 26'. In certain applications where seawater is being pumped, such as reverse osmosis desalination systems, the seawater must first be filtered so that the seawater is pressurized to push the seawater through the filters. Typically, the inlet seawater pressure is about 15–50 psi. This pressure must be reduced before delivery of the seawater to cavity 64, so reduction valve 31 or orifice 122 are used. Alternatively, a pressured coolant such as tap water or the like which will induce a flow of the coolant through pump 10 could also be used.

After the desired connections are made, shaft 66 is rotated by the motor or the like to cause swash plate 62 to rotate within cavity 64. As swash plate 62 rotates, ramp surface 102 continually contacts each piston wear pad 60 or slipper bearing 131 of a respective piston 52. Thus, when piston wear pad 60 contacts lower-most surface portion 104, the associated piston 52 is at the lowest point of its stroke. Then, as ramp surface 102 rotates past a particular piston wear pad 60 or slipper bearing 131, piston wear pad 60 or slipper bearing 131 and the associated piston 52 are raised to the uppermost point of the stroke of the piston at the location of uppermost surface portion 106 as depicted in FIGS. 2 and 6. As ramp surface 102 contacts each piston wear pad 60 or slipper bearing 131 during the upward movement of the associated piston 52, the opposite side of wash plate 62 contacts an associated wear pad 98 or 98A. Thus, the reaction force for driving each piston 52 acts through the associated wear pad 98 or 98A.

Continued rotation of ramp surface 102 allows piston 52 to complete a downward stroke to the lower-most point at the location of lower-most surface portion 104. Piston 52 is forced downwards by the pressure of the liquid in inlet piping 26' as the liquid flows past inlet one-way valve means 40. It should be appreciated that the pressure of the liquid in inlet piping 26' must be greater than the pressure on the opposite side of piston 52 in cavity 64. As the pressure in cavity 64 is created by the coolant liquid flowing in piping 30' which comes from inlet piping 26', reduction valve 31 or orifice 122 is required to reduce the pressure before delivery to cavity 64. Typically, where the pressure in inlet piping 26' is 15–50 psi and preferably 15–30 psi, reduction valve 31 reduces the pressure in cavity 64 to about 2 to 10 psi. FIG. 2 schematically illustrates any suitable means for supplying fluid to inlet piping 26' under pressure.

During the downward stroke of piston 52 as corrosive liquid is forced into the associated cylinder 50 from inlet port 26 and inlet channel 32 through inlet one-way valve means 40, the pressure of the corrosive liquid keeps outlet one-way valve means 42 closed. As soon as piston 52 starts its upward stroke, the liquid contained in cylinder 50 is further pressurized and causes inlet one-way valve means 40 to close and outlet one-way valve means 42 to open. The corrosive liquid is then pumped from cylinder 50 through outlet bore 48 and outlet one-way valve means 42 to outlet channel 34 and outlet port 28 during the upward stroke of piston 52. It should be appreciated that sealing means 54 for piston 52 can allow some leakage without adversely affecting the operation of pump 10 where the corrosive fluid being pumped is also used as the coolant. Thus, leakage past piston 52 does not introduce any new or harmful fluid into pump 10, and the corrosive liquid in pump 10 already is properly disposed of by a suitable connection to coolant outlet 94.

As shaft 66 rotates, friction is developed between shaft 66 and bearings 72 and 86, and possibly bearing 70 (although bearing 70 is normally kept out of contact with the end of shaft 66 because of the contact between piston wear pads 60 or slipper bearings 131 and ramped surface 102). The friction is low, and is a consequence of the shearing of the water films which are held by chemical forces to the opposing solid surfaces. At the same time friction is developed, coolant liquid is conducted through coolant inlet port 30 and bore 74 to journaling means 68. This coolant liquid is then conducted along channels 78 of thrust bearing 70 and subsequently through channels 82 of shaft bearing 72. This coolant liquid serves not only to cool bearings 70 and 72, but due to the materials of construction of shaft 66 and bearings 70 and 72, the coolant liquid further serves to reduce the friction generated between these surfaces. From channels 82, the coolant liquid enters cavity 64 of cylinder housing 18 or 18A and 18B. In cavity 64, the coolant liquid similarly serves to both cool and lubricate ramp 102, the back surfaces of swash plate 62, and wear pads 60 or slipper bearings 131 and wear pads 98. The slightly pressurized coolant liquid in cavity 64 then enters channels 90 of shaft bearing 86 to similarly cool and lubricate shaft bearing 86 and shaft 66. Finally, the coolant liquid exits pump body 12 through bore 92 and coolant outlet port 94.

Where a suitable corrosive liquid is being pumped which is not initially pressurized, the corrosive liquid can additionally be used as the coolant liquid. In order to accomplish this, a connection (with pressure reduction) is provided between the pumped corrosive liquid exiting from outlet port 28 and coolant inlet port 30.

In the case where seawater is pumped, coolant outlet port 94 is then simply connected back to the sea.

It is anticipated that pump 10 of the present invention can be used to pump approximately 0.1–120 liter per minute of a wide range of corrosive and non-corrosive fluids over a pressure range of 0 to 1,000 psi when operated at between 50–1750 rpm. The lower tensile strengths of plastics, relative to metals, limits the operation of pump 10 shown in FIG. 2 to approximately 500 psi and that shown in FIG. 6 to 1,500 psi. However, with proper fiber reinforcement, this limit can be increased to about 1,500 to 2,500 psi. The thermoplastic nature of some of the materials used in pump 10 also limits the operating temperature of the fluid being conveyed to approximately 150° F. However, by switching these elements to a thermoset material or a thermoplastic with higher distortion temperatures, this temperature limit could be increased to approximately 200° to 300° F.

Pump 10 of the present invention provides a reliable and efficient pump which will operate over an extended period of time with little or no maintenance. This efficiency and reliability is achieved by use of the unique flow through cooling design in conjunction with the non-metallic bearing materials. The water cooling flow rate for pump 10 is between 0.1–2.0 1/min., depending on speed, pressure and temperature. These non-metallic bearing materials can be operated at loads and speeds that are a factor of 10–20 higher than loads obtainable under dry conditions. In addition, the low cost construction and noncorrodible nature of pump 10 make it ideal for use in commercial applications such as reverse osmosis and chemical feed, and the domestic market for such high pressure applications as cleaning and washdown for homes, autos, and boats. Furthermore, the fluid cooled drive-end could be used in other systems requiring a rotary power source converted into a linear displacement such as hydraulic tool systems and motors.

The making of one-way valve means 40 to 42 from a material from the selected materials is particularly advantageous since a separate sealing ring or the like is not needed for the ball. Rather, the specific materials chosen for the ball and outlet portion are such that they are sufficiently resilient to allow seating of the ball directly into the outlet portion. In this manner, any wear in either the ball or seat material is compensated for by the remaining material. Thus, there is no critical sealing ring or the like to wear away and cause a failure.

Although the camming or bearing surfaces depicted in pump 10 have been simple plane surfaces, it should be appreciated that these bearing surfaces could also be constructed as either ball or roller bearing surfaces or the like. In such a construction, the ball bearings and associated races would similarly be made of a thermoplastic or thermosetting plastic in order to achieve the same advantages and objects of the present invention.

It should also be appreciated that the pistons and cylinders could also be radially displaced rather than axially, with the shaft carrying a cam having an eccentric shape. Similarly, the ramp of such a ca (and also the ramped surface 102 of swash plate 62) could be of various geometries including multiple ramps to give more than one stroke per revolution, and stacked balanced cams. The stroke length could also be varied by changing the slope of the ramp. In addition, the number of cylinders and their radial spacing could be altered in order to change the output capacity of the pump.

A particularly important aspect of the invention is the use of pressurized inlet fluid to refill the cylinders. This feature markedly reduces the complexity of the pump design, eliminating the need for crank arms, wrist pins, refill springs, yokes, ball joints, etc. and increases the pump's resistance to wear induced failure. In particular the pistons can be considered equivalent to brushes in a motor. Even though this will normally happen, the pump of this invention could lose 0.15 or more inches from the second camming surface on the pistons without reducing the pump's volumetric efficiency or intorudcing any unwanted play or backlash.

Thus, while the present invention has been described above with respect to the two exemplary embodiments thereof, it will be understood by those of ordinary skill in the art that variations and modifications can be effected within the scope and spirit of the invention.

What is claimed is:

1. A high pressure positive displacement piston pump for pumping a corrosive aqueous fluid, comprising a pump body including plate means, said plate means comprising an outer plate and an inner valve plate mounted thereto, said pump body having inlet means, means for supplying the fluid to said inlet means under pressure, a plurality of cylinders mounted therein, an axially rotating member in said pump body, a first plate mounted to said rotating member for joint rotation therewith, said first plate having a first camming surface, a piston in each of said cylinders, each of said pistons having a piston head at one end thereof and a second camming surface at its opposite end, said piston head being located in a piston head chamber at one end of its said cylinder, each of said second camming surfaces riding against said first camming surface whereby rotation of said rotating member periodically overcomes the opposing force of the fluid pressure acting against each of said piston heads and thereby causes each of said piston heads to reciprocate axially in its said piston head chamber, said inlet means including an exposed inlet port in said outer plate, a plurality of inlet one-way valve means in said valve plate corresponding to the number of said cylinders with each of said inlet valve means being associated with a respective one of said cylinders, an inlet channel creating flow communication between said inlet port and said plurality of said inlet valve means, each of said inlet valve means being in flow communication with a respective piston head chamber, an exposed outlet port in said valve place corresponding to the number of said cylinders with each of said outlet valve means being associated with a respective one of said cylinders, an outlet channel creating flow communication between said outlet port and said plurality of said outlet valve means, each of said outlet valve means communicating with a respective piston head chamber, a corrosive fluid path formed by the elements of said inlet port and aid inlet channel and said inlet valve means and said piston head chamber and said outlet valve means and said outlet channel as said outlet port, of all of said elements of said pump body which comprise said corrosive fluid path being made of a material which is non-corrodible in the aqueous fluid, a lubricating and cooling means for lubricating and cooling said first and second camming surfaces, said lubricating and cooling means including a liquid coolant and lubricant in contact with said first and second camming surfaces, the fluid being pumped being the same as said liquid coolant and lubricant, said lubricating and cooling means including a coolant passageway in flow communication with the corrosive aqueous fluid whereby the fluid supplied to said inlet port also flows into said coolant passageway, said coolant passageway communicating with said first and said second camming surfaces, a coolant outlet passage downstream from said first and said second camming surfaces and exiting from said pump body, said second camming surface being a removable insert at the end of said piston, and at least one of said first and second camming surfaces being formed of an organic material.

2. A piston pump as claimed in claim 1 wherein said inlet channel is an annular groove in the surface of said outer plate juxtaposed on the surface of said valve plate, and said outlet channel being an annular groove concentric with and co-planar to said inlet channel.

3. A piston pump as claimed in claim 1 wherein said pump body includes a back plate remote from said outer plate said axially rotating member being rotatably mounted through said back plate, and said camming surfaces and said back plate being made of a material which is non-corrodible in the aqueous fluid.

4. A piston pump as claimed in claim 1 wherein said first camming surface is made of an epoxy and aid second camming surface is made of ultra high molecular weight polyethylene.

5. A piston pump as claimed in claim 1 wherein said cylinder includes a cylinder liner made of an epoxy resin.

6. A piston pump as claimed in claim 1 wherein aid cylinder includes a cylinder liner made of a corrosion resistant metal alloy.

7. A piston pump as claimed in claim 1 wherein said coolant -passageway is in flow communication with the corrosive aqueous fluid by being in flow communication with said inlet port, and said coolant passageway extending through said end plate and said valve plate and communicating with said first and said second camming surfaces.

8. A piston pump as claimed in claim 1 wherein said second camming surface comprised a slipper bearing mounted to a ball and joint socket at said opposite end of said piston.

9. A piston pump as claimed in claim 8 wherein said rotating member includes a shaft and a means for journaling said shaft for rotation in said pump body, said shaft being made of stainless steel, said journaling means being made of a material selected from the group consisting of polyamide-imide and polyimide plastic, and said lubricating and cooling means also cooling said journaling means and said shaft.

10. A piston pump as claimed in claim 1 wherein said fluid is supplied to said inlet means at a pressure of 15–50 psi.

11. A piston pump as claimed in claim 10 wherein said fluid is supplied at a pressure of 15–30 psi.

12. A piston pump as claimed in claim 1 wherein the organic material is selected from the polymer group consisting of epoxies, polyvinyl chloride, acetal, polyester, polyimide, polyamide, polyamide-imide, Imilon, polysulfone, polyether etherketone, polyphenylene oxide, teflon, ultra high molecular weight polyethylene, and polyurethane.

13. A piston pump as claimed in claim 12 wherein said rotating member includes a shaft and a means for journaling said shaft for rotation in said pump body, said shaft including an outer surface made of a material from said organic material, sand said lubricating and cooling means also cooling said journaling means and said shaft.

14. A piston pump as claimed in claim 12 wherein said pump body, said inlet one-way valve means, said outlet one-way valve means, and said piston are all made of said organic material, and said pump body including a journaling means for journaling said rotating member for rotation, said journaling means being made of said organic material.

15. A piston pump as claimed in claim 14 wherein said first camming surface is made of a corrosion resistant metallic alloy, and said second camming surface is made of a material selected from the group consisting of polyamide-imide and polyimide plastic.

16. A piston pump as claimed in claim 14 wherein said first camming surface is made of an epoxy and said second camming surface is made of ultra high molecular weight polyethylene.

17. A piston pump as claimed in claim 12 wherein said rotating member includes a swash plate on which said first camming surface is located; and wherein said cam means further including a wear pad located on said pump body on the opposite side of said swash plate from said first camming surface with said swash plate bearing against said wear pad as said first and second camming surfaces engage, said wear pad being made of said organic material.

18. A piston pump as claimed in claim 17 wherein said wear pad is made of a polyethylene.

19. A piston pump as claimed in claim 17 wherein said wear pad is made of a material selected from the group consisting of polyamide-imide and polyimide plastic.

20. A piston pump as claimed in claim 17 wherein said wear pad is supported by an elastic supporting pad which is positioned in an off-set fashion so as to incline the wear pad slightly when under load.

* * * * *